US010174729B2

(12) United States Patent
Atzkern et al.

(10) Patent No.: US 10,174,729 B2
(45) Date of Patent: Jan. 8, 2019

(54) INJECTOR FOR A FUEL SUPPLY SYSTEM OF AN INTERNAL COMBUSTION ENGINE AND FUEL SUPPLY SYSTEM

(71) Applicants: Thomas Atzkern, Oberottmarshausen (DE); Maximilian Indrich, Kissing (DE); Stefan Kern, Augsburg (DE); Claudius Weber, Ulm (DE); Ludwig Maier, Diedorf (DE); Holger Schaar, Fischach/OT Itzlishofen (DE); Wolfgang Wagner, Dessau (DE); Thomas Klaua, Augsburg (DE); Harald Wellenkötter, Augsburg (DE); Werner Wörle, Baar (DE)

(72) Inventors: Thomas Atzkern, Oberottmarshausen (DE); Maximilian Indrich, Kissing (DE); Stefan Kern, Augsburg (DE); Claudius Weber, Ulm (DE); Ludwig Maier, Diedorf (DE); Holger Schaar, Fischach/OT Itzlishofen (DE); Wolfgang Wagner, Dessau (DE); Thomas Klaua, Augsburg (DE); Harald Wellenkötter, Augsburg (DE); Werner Wörle, Baar (DE)

(73) Assignee: MAN Energy Solutions SE, Augsburg (DE)

( * ) Notice: Subject to any disclaimer, the term of this patent is extended or adjusted under 35 U.S.C. 154(b) by 41 days.

(21) Appl. No.: 13/894,145

(22) Filed: May 14, 2013

(65) Prior Publication Data

US 2014/0007845 A1 Jan. 9, 2014

(30) Foreign Application Priority Data

May 15, 2012 (DE) ..... 10 2012 208 075

(51) Int. Cl.
*F02M 61/10* (2006.01)
*F02M 41/16* (2006.01)
*F02M 61/16* (2006.01)

(52) U.S. Cl.
CPC ..... *F02M 41/16* (2013.01); *F02M 61/168* (2013.01); *F02M 2200/803* (2013.01);
(Continued)

(58) Field of Classification Search
CPC .... F02M 63/0225; F02M 61/10; F02M 61/18; F02M 47/02; F02M 2200/02;
(Continued)

(56) References Cited

U.S. PATENT DOCUMENTS 2,330,610 A * 9/1943 Natter ..... F16K 1/427 137/509
2,749,181 A * 6/1956 Maxwell et al. ..... 239/584
(Continued)

FOREIGN PATENT DOCUMENTS

AT 505 666 B1 3/2009
AT 508 050 9/2011
(Continued)

OTHER PUBLICATIONS

English translation of an Office Action dated Mar. 20, 2017 which issued in the corresponding Chinese Patent Application No. 201310178812.0.
(Continued)

*Primary Examiner* — Marguerite McMahon
*Assistant Examiner* — Tea Holbrook
(74) *Attorney, Agent, or Firm* — Cozen O'Connor

(57) ABSTRACT

An injector for a fuel supply system of an internal combustion engine, namely for a common rail fuel supply system of an internal combustion engine which is formed in particular as a large diesel internal combustion engine or ship's diesel
(Continued)

internal combustion engine, having an injection nozzle, a control valve and a retaining body. The injection nozzle and the control valve form a clamped composite, and the composite formed of the injection nozzle and control valve can be mounted on the retaining body as a unit and disassembled from the retaining body as a unit.

13 Claims, 4 Drawing Sheets

(52) U.S. Cl.
CPC ..... *F02M 2200/8023* (2013.01); *F02M 2200/8076* (2013.01)

(58) Field of Classification Search
CPC ..... F02M 2200/28; F02M 2200/80; F02M 51/0685; F02M 2200/803; F02M 2200/855; F02M 55/004
USPC ..... 123/445, 447; 239/5, 88–92, 96, 239/533.2–533.12, 585.1–585.5, 600
See application file for complete search history.

(56) References Cited

U.S. PATENT DOCUMENTS 3,004,720 A * 10/1961 Steinke ..... F02D 41/30 239/533.3
3,279,706 A * 10/1966 Kennedy ..... F02M 61/10 239/533.3
4,310,123 A * 1/1982 TePastte ..... F02M 51/0685 239/585.2
4,344,575 A * 8/1982 Seifert ..... F02M 45/083 239/533.5
4,546,739 A * 10/1985 Nakajima et al. ..... 123/299
4,598,743 A * 7/1986 Milling ..... B60K 15/04 141/198
4,840,310 A * 6/1989 Haider ..... F02M 45/08 239/533.4
4,907,745 A 3/1990 Messingschlager
5,154,350 A * 10/1992 Ausiello ..... F02M 47/027 239/533.8
5,161,742 A * 11/1992 Hofmann et al. ..... 239/533.9
5,241,935 A * 9/1993 Beck ..... F02M 47/02 123/300
5,375,576 A 12/1994 Ausman et al.
5,511,528 A * 4/1996 Iwanaga ..... F02D 41/3836 123/198 DB
5,537,972 A * 7/1996 Beck ..... F02M 47/02 123/198 D
5,564,633 A * 10/1996 Hardy ..... F02M 61/168 239/533.2
5,836,521 A * 11/1998 Holm ..... B05B 1/3073 239/584
6,056,155 A 5/2000 Byerly et al.
6,257,499 B1 * 7/2001 Sturman ..... 239/96
6,273,349 B1 * 8/2001 Fischbach ..... F02M 51/0671 239/494
6,561,165 B1 5/2003 Hlousek
6,666,390 B2 * 12/2003 Itou ..... 239/600
6,719,221 B2 * 4/2004 Klugl et al. ..... 239/533.3
6,880,766 B2 * 4/2005 Lewis et al. ..... 239/88
6,929,247 B2 8/2005 Kienzler et al.
7,407,120 B1 8/2008 French
2002/0014540 A1 * 2/2002 Cooke ..... F02M 51/0603 239/102.1
2003/0094516 A1 5/2003 Hanneke et al.
2003/0110780 A1 * 6/2003 Enomoto ..... B60H 1/3205 62/7
2004/0046059 A1 * 3/2004 Kienzler et al. ..... 239/533.2
2004/0060998 A1 4/2004 Stoecklein et al.
2004/0187848 A1 * 9/2004 Hlousek ..... F02M 47/027 123/447
2006/0151637 A1 * 7/2006 Schneider et al. ..... 239/533.2
2008/0185462 A1 * 8/2008 Ruthardt ..... F02M 51/0603 239/589
2009/0108093 A1 * 4/2009 Mattes et al. ..... 239/96
2009/0261184 A1 10/2009 Petrecchia et al.
2009/0277421 A1 * 11/2009 Eisenmenger ..... 123/456
2009/0326788 A1 * 12/2009 Yuasa ..... F02D 41/3809 701/104
2010/0006068 A1 * 1/2010 Maier ..... F02M 51/061 123/472
2010/0102147 A1 * 4/2010 Uhlmann et al. ..... 239/589
2010/0294243 A1 * 11/2010 Ganser et al. ..... 123/476
2010/0301143 A1 * 12/2010 Adachi ..... F02M 47/02 239/533.3
2010/0313853 A1 * 12/2010 Morris ..... F02M 51/0603 123/472
2012/0305823 A1 * 12/2012 Uhlmann ..... 251/356
2013/0206111 A1 8/2013 Riepl et al.
2013/0220271 A1 * 8/2013 Graspeuntner et al. ..... 123/294

FOREIGN PATENT DOCUMENTS

CN 101558231 10/2009
CN 101560935 10/2009
DE 197 05 227 8/1998
DE 19705227 8/1998
DE 198 43 915 3/2000
DE 100 23 952 11/2001
DE 101 57 135 6/2003
DE 102 40 880 3/2004
DE 10308361 11/2004
DE 102005020833 11/2006
DE 102006051581 A1 * 5/2008 ..... F02M 47/02
DE 10 2008 040 637 1/2010
DE 102008042158 * 3/2010 ..... F02M 47/02
DE 102012205701 * 10/2013 ..... F02M 61/14
DE 102012211157 A1 * 1/2014 ..... F02M 1/005
EP 1 306 546 5/2003
JP S 64-36973 2/1989
JP H02-241974 9/1990
JP 2003-503629 1/2003
JP 2003-148298 5/2003
JP 2004-520513 7/2004
JP 2005-509781 4/2005
JP 2009-293541 12/2009
WO WO 2012/025442 3/2012

OTHER PUBLICATIONS

Office Action dated Oct. 29, 2018 issued in Korean Patent Application No. 10-2013-0053781.

* cited by examiner

INJECTOR FOR A FUEL SUPPLY SYSTEM OF AN INTERNAL COMBUSTION ENGINE AND FUEL SUPPLY SYSTEM

BACKGROUND OF THE INVENTION

1. Field of the Invention

The invention is directed to an injector for a fuel supply system of an internal combustion engine and a fuel supply system of an internal combustion engine.

2. Description of the Related Art

DE 101 57 135 B4 discloses an internal combustion engine, namely a ship's diesel internal combustion engine operating on heavy oil, which has a plurality of cylinders, an injector of a common rail fuel supply system associated with each cylinder of the internal combustion engine. Fuel can be injected into each cylinder of the internal combustion engine by the injectors, which are also referred to as fuel injectors. The common rail fuel supply system according to DE 101 57 135 B4 comprises a pump arrangement having a plurality of high-pressure pumps to convey fuel from a low-pressure region of the common rail fuel supply system into a high-pressure region thereof. A pressure accumulator system, which is permanently under high pressure, is provided in the high-pressure region between the pump arrangement and the injectors. According to DE 101 57 135 B4, the pressure accumulator system, which is permanently under high pressure and is also referred to as common rail, has a plurality of storage units and is connected to the pump arrangement by high-pressure fuel lines, which are likewise permanently under high pressure. The pressure accumulator system is further connected to the injectors by high-pressure fuel lines, which are occasionally under high pressure depending on the injection stroke. Associated with the high-pressure fuel lines which are occasionally under high pressure depending on the injection stroke and which connect the injectors to the pressure accumulator system, are switching valves that feed fuel to the injectors depending on the injection stroke.

Due to the fact that the spatial distance between the injectors of the fuel supply system and the pressure accumulator system thereof can be relatively large in large diesel internal combustion engines or ship's diesel internal combustion engines and, the high-pressure fuel lines, which are occasionally under high pressure depending on the injection stroke and that connect the injectors to the pressure accumulator system can be relatively long, there are already known injectors which, in addition to an injection nozzle serving for the actual injection of fuel into a cylinder of the internal combustion engine and in addition to a control valve, include a storage which provides a fuel storage volume tailored to the individual injector so as to reduce pressure losses.

Accordingly, AT 505 666 B1 discloses an injector of a common rail fuel supply system which, in addition to the injection nozzle and the control valve that is formed as a solenoid valve, includes a retaining body, known as an injector body, which provides a high-pressure storage. According to the prior art, a throttle plate is positioned between the solenoid valve and the injection nozzle. The injection nozzle and the solenoid valve of the injector are formed of a plurality of individual parts. The solenoid valve, throttle plate and injection nozzle are mounted on the retaining body by a nozzle clamping nut. Mounting the injection nozzle, throttle plate and solenoid valve on the retaining body by the nozzle clamping nut is time-consuming because, as was already mentioned, the elements to be clamped to the retaining body consist of a large number of individual parts. Some of these individual parts are delicate and sensitive so that assembly must be carried out with great precision and skill. This requires highly qualified personnel.

SUMMARY OF THE INVENTION

There is a need for an injector for a fuel supply system that can be assembled and dismantled in the region of the retaining body with less effort.

It is an object of one embodiment of the present invention to provide a novel injector for a fuel supply system and a novel fuel supply system with injectors of this kind.

According to one embodiment of the invention, the injection nozzle and the control valve form a clamped composite or assembly, and the composite or assembly formed of the injection nozzle and control valve can be mounted on the retaining body as a unit and disassembled from the retaining body as a unit.

According to one embodiment of the invention, it is suggested that the injection nozzle and the control valve are provided as a clamped composite and that this composite formed of the injection nozzle and control valve is mounted on the retaining body and disassembled from the retaining body. Therefore, the composite comprising the injection nozzle and control valve, each of which has a quantity of delicate, sensitive components, can be preassembled as a composite. The actual mounting of this preassembled, pre-clamped composite at the retaining body can then be carried out with relatively little effort by personnel with little training.

A further advantage of a clamped composite comprising injection nozzle and control valve results from the fact that particularly the retaining body and the storage provided by the retaining body or the separate storage tailored to the injector are relatively resistant to wear so that it is possible for the components which are prone to wear, namely the injection nozzle and the solenoid valve, to be disassembled as a unit from the internal combustion engine, that is, from the respective retaining body thereof, and replaced by a new unit comprising control valve and retaining body in a simple manner.

According to one embodiment, the control valve and the injection nozzle each have at least one radially inwardly directed recess at a radially outer lateral surface, a clamping sleeve has radially inwardly directed projections that engage in the respective radially inwardly directed recess of the control valve and injection nozzle, and the clamping sleeve covers parting surfaces between the elements of the composite which are to be clamped. This further development of the invention is particularly simple with respect to construction and manufacture. The recesses can be incorporated in the outer lateral surface of the control valve and injection nozzle in a simple manner. A relatively thin-walled, inexpensive sleeve can be used.

According to one embodiment, the control valve has at least one radially inwardly directed recess or at least one shoulder at a radially outer lateral surface, and a clamping sleeve has at least one radially inwardly directed projection at a first portion, which radially inwardly directed projection cooperates with the respective radially inwardly directed recess or the shoulder of the control valve for fixing the clamping sleeve in position on the control valve, and the clamping sleeve has an internal thread at a second portion, which internal thread cooperates with an external thread of the injection nozzle, and the clamping sleeve covers parting surfaces between the elements of the composite which are to be clamped. This variant of the invention can also be easily realized in terms of construction. According to this advantageous further development, the clamping sleeve which is screwed to the injection nozzle while clamping the composite comprising injection nozzle and control valve can be reused.

According to one embodiment, bore holes, which extend in longitudinal direction and cooperate with clamping screws, are incorporated in the control valve and injection nozzle. This embodiment of the invention can be realized in a simple manner with respect to construction, but requires bore holes to be made in the control valve and injection nozzle for the clamping screws.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

BRIEF DESCRIPTION OF THE DRAWINGS

Preferred further developments of the invention are indicated in the subclaims and the following description. Embodiment examples of the invention are described more fully with reference to the drawings without the invention being limited to these embodiment examples. The drawings show:

DETAILED DESCRIPTION OF THE PRESENTLY PREFERRED EMBODIMENTS

The present invention is directed to a common rail fuel supply system of a large diesel internal combustion engine, particularly of a ship's diesel internal combustion engine operating on heavy oil. Common rail fuel supply systems of this kind have a low-pressure region and a high-pressure region.

The high-pressure region of a common rail fuel supply system comprises a pump arrangement 102 having at least one high-pressure pump and a pressure accumulator system 101 having at least one storage unit. The pump arrangement delivers fuel from the low-pressure region to the high-pressure region and is connected to the pressure accumulator system by at least one high-pressure fuel line 105. The pressure accumulator system and the high-pressure fuel line, or each high-pressure fuel line, connecting the pressure accumulator system to the pump arrangement are permanently under high working pressure.

Starting from the pressure accumulator system, the fuel can be injected into cylinders by injectors, each injector being connected to the pressure accumulator system by at least one high-pressure fuel line 104, which is also permanently under high working pressure.

Figure 1:
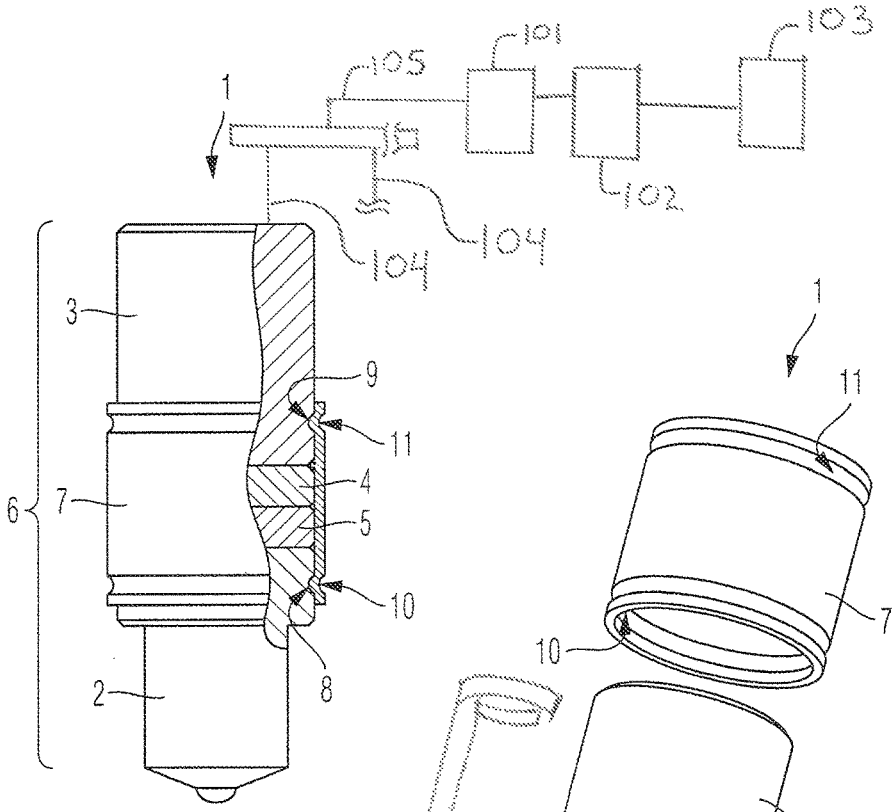
FIG. 1 is a highly schematic cross section through a portion of an injector of a common rail fuel supply system.
Figure 2:
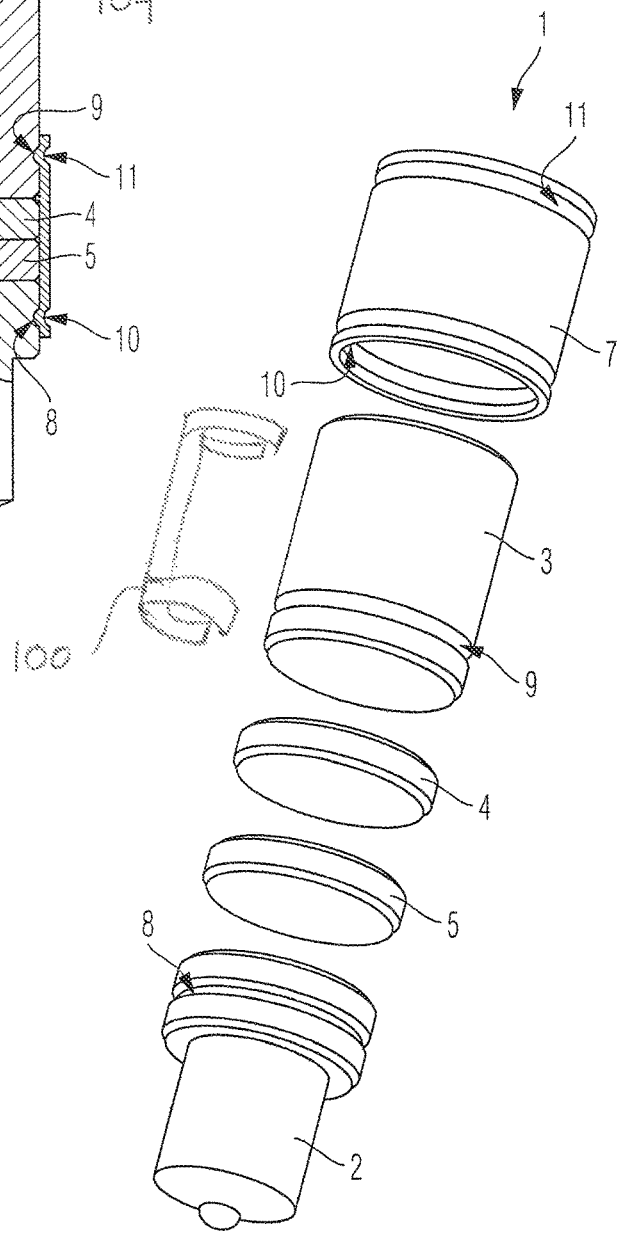
FIG. 2 is a highly schematic exploded view of the injector of FIG. 1.

FIGS. 1 and 2 show details of a first injector 1 of a common rail fuel supply system. The components of the injector 1 shown in FIGS. 1 and 2 are the injection nozzle 2, a control valve 3 and intermediate plates 4 and 5, i.e., a valve plate 4 and a throttle plate 5, which are positioned between the injection nozzle 2 and the control valve 3. Also, the injector 1 has a retaining body 100, shown in FIG. 2, which is engaged by the control valve 3. This retaining body preferably provides a storage for fuel that is individualized for the injector.

The injection nozzle 2 and the control valve 3 have a plurality of delicate components. In order to facilitate mounting of the injection nozzle 1 and control valve 3 on the retaining body of the respective injector 1 and, therefore, on the internal combustion engine, it is suggested according to one embodiment of the invention that the injection nozzle 2 and control valve 3 are formed or provided as a clamped composite 6, so that the composite 6 formed of the injection nozzle 2 and control valve 3 can be mounted on the retaining body as a unit and disassembled from the retaining body as a unit in a simple manner.

In the embodiment shown in FIGS. 1 and 2, in which the valve plate 4 and throttle plate 5 are positioned between the control valve 3 and the injection nozzle 2, these intermediate plates 4 and 5 are also clamped together with the injection nozzle 2 and control valve 3 to form the composite 6, so that this unit can be mounted on the retaining body, not shown, of the injector 1 and disassembled therefrom in a simple manner.

In the embodiment shown in FIGS. 1 and 2, the control valve 3, the injection nozzle 2 and the intermediate plates 4 and 5 positioned therebetween in the embodiment shown in FIGS. 1 and 2 are clamped of a clamping sleeve 7. A radially inwardly directed recess 8 is formed at an outer lateral surface of the injection nozzle 2, and a radially inwardly directed recess 9 is formed at an outer lateral surface of the control valve 3, and radially inwardly directed projections 10 and 11 of the clamping sleeve 7 respectively engage in these recesses 8 and 9. In the embodiment shown in FIGS. 1 and 2, the recesses 8 and 9 are formed at the outer lateral surfaces of the injection nozzle 2 and control valve 3 as circumferential grooves, and the projections 10 and 11 of the clamping sleeve 7 are formed as circumferential beads that engage in these grooves. The clamping sleeve 7 is a relatively thin-walled clamping sleeve 7 and, after being fitted over the injection nozzle 2 and control valve 3, can be deformed such that its projections 10 and 11 engage in the recesses 8 and 9 of injection nozzle 2 and control valve 3 by positive engagement while clamping the composite 6. The deformation of the clamping sleeve 7 is preferably effected through plastic deformation thereof. It can be seen from FIG. 1 that in the clamped state of the composite 6 the clamping sleeve 7 covers parting surfaces between the clamped components, i.e., a parting surface between the control valve 3 and the valve plate 4, a parting surface between the valve plate 4 and the throttle plate 5, and a parting surface between the throttle plate 5 and the injection nozzle 2. In this way, a sealing function is provided by the clamping sleeve 7 with respect to these parting surfaces.

Figure 3:
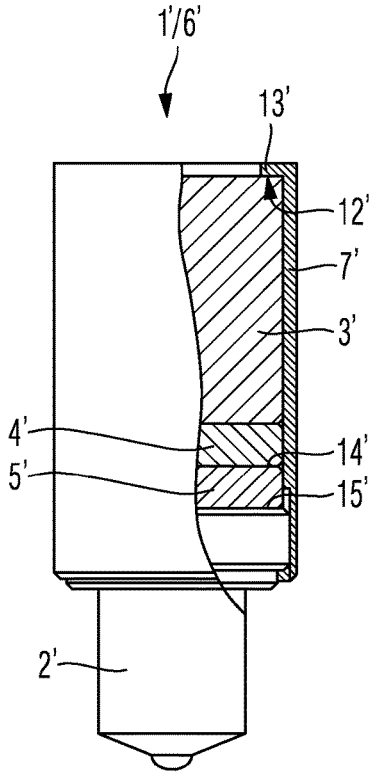
FIG. 3 is a highly schematic cross section through a portion of an injector of a common rail fuel supply system.
Figure 4:
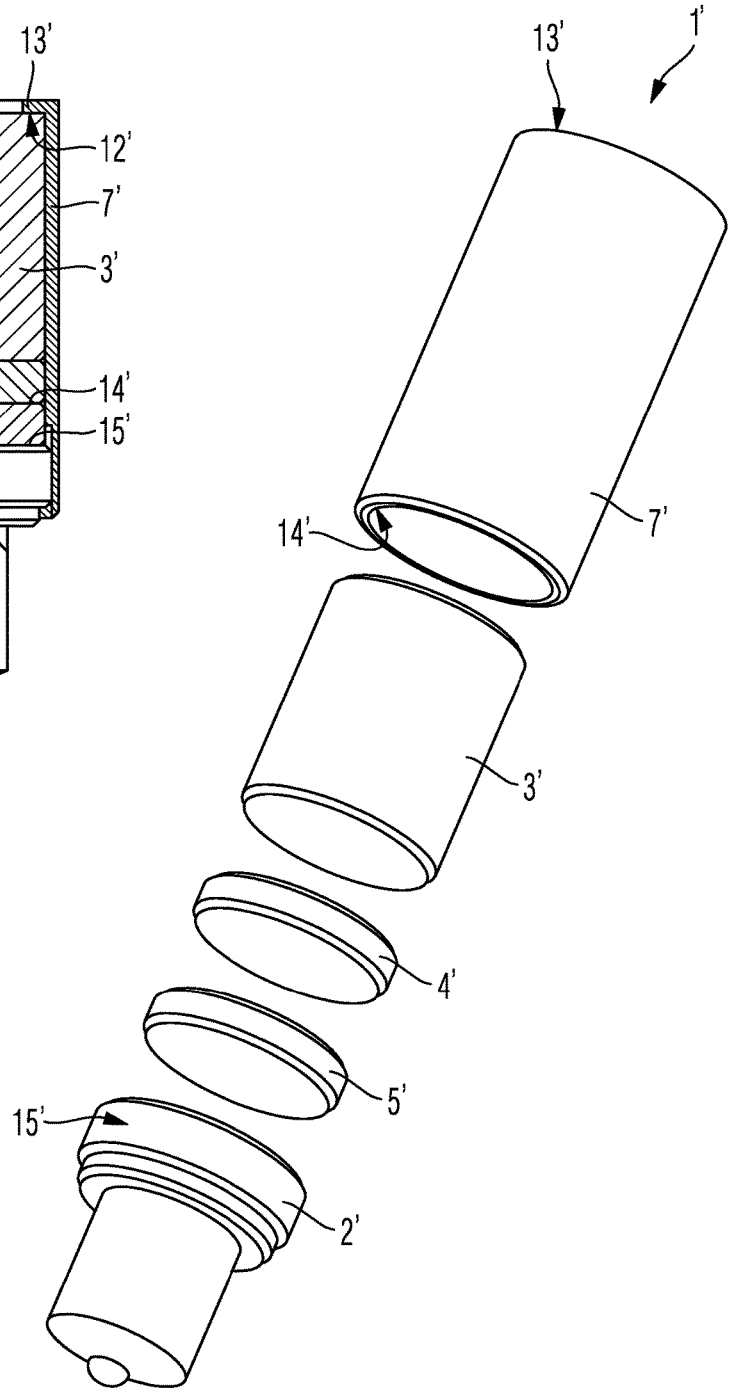
FIG. 4 is a highly schematic exploded view of the injector of FIG. 3.

FIGS. 3 and 4 show a second embodiment of an injector 1' in the region of an injection nozzle 2', a control valve 3' and the intermediate plates 4' and 5', namely the valve plate 4' and throttle plate 5', positioned between the injection nozzle 2' and control valve 3'. In the embodiment shown in FIGS. 3 and 4, these assemblies are also clamped together as composite 6' by a clamping sleeve 7'. Accordingly, the clamping sleeve 7' serves to clamp the control valve 3', injection nozzle 2' and the two intermediate plates 4' and 5'. In the clamped state of the composite 6', the clamping sleeve 7' again covers parting surfaces between the clamped elements 2', 3', 4' and 5'. However, the specific construction or configuration of the clamping sleeve 7' in the embodiment example in FIGS. 3 and 4 differs from the embodiment example in FIGS. 1 and 2.

In the embodiment in FIGS. 3 and 4, a shoulder 12' is formed at the radially outer lateral surface of the control valve 3' and cooperates with a radially inwardly directed projection 13' of the clamping sleeve 7' such the clamping sleeve 7' is fixed in position at the control valve 3'. At an oppositely located portion, the clamping sleeve 7' has an internal thread 14' which cooperates with an external thread 15' of the injection nozzle 2', specifically in such a way that elements 2', 3', 4' and 5' are clamped as composite 6' when the injection nozzle 2' and clamping sleeve 7' are screwed together by their threads 14' and 15'.

Figure 5:
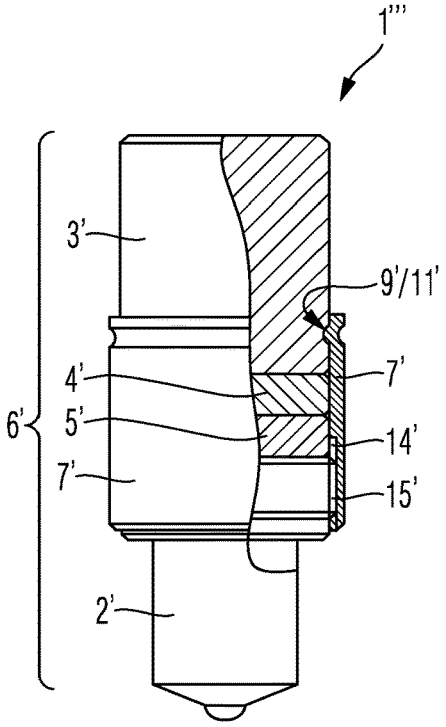
FIG. 5 is a modification of FIG. 3.
Figure 6:
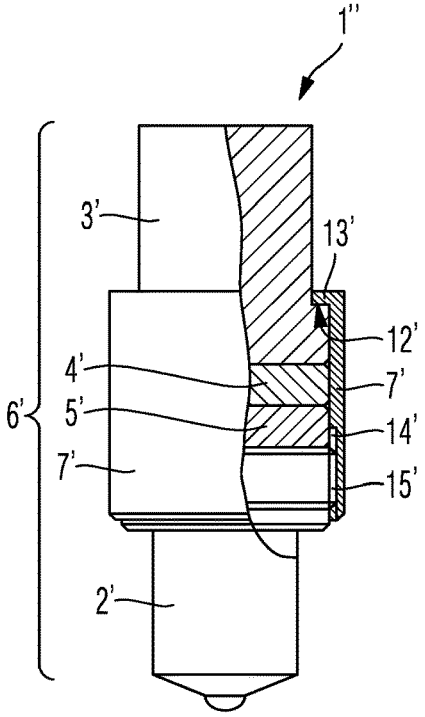
FIG. 6 is a further modification of FIG. 3.

FIGS. 5 and 6 show injectors 1" and 1''', which are modifications of the injector 1' from the embodiment in FIGS. 3 and 4. Therefore, to prevent unnecessary repetition, the same reference numerals are used for the same assemblies and only the details distinguishing the embodiment of FIGS. 5 and 6 from the embodiment of FIGS. 3 and 4 will be addressed in the following.

The embodiment in FIG. 6 differs from the embodiment in FIGS. 3 and 4 only in that the shoulder 12' of the control valve 3' which, together with the projection 13' of the clamping sleeve 7', provides for fixing the position between the clamping sleeve 7' and control valve 3' is formed at a middle portion of the control valve 3' for geometric shortening of the clamping sleeve 7'.

The embodiment of FIG. 5 differs from the embodiment in FIGS. 3 and 4 in that a circumferential groove 9' is formed at the outer lateral surface of the control valve 3' corresponding to the embodiment of FIGS. 1 and 2, and a circumferential projection 11' of the clamping sleeve 7' engages by positive engagement in the circumferential groove 9' to fix the clamping sleeve 7' in position at the control valve 3'.

Figure 7:
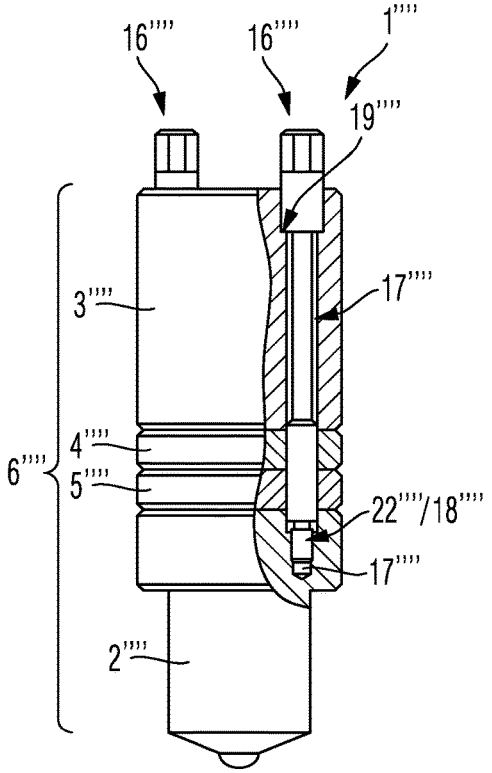
FIG. 7 is a highly schematic cross section through a portion of an injector of a common rail fuel supply system.
Figure 8:
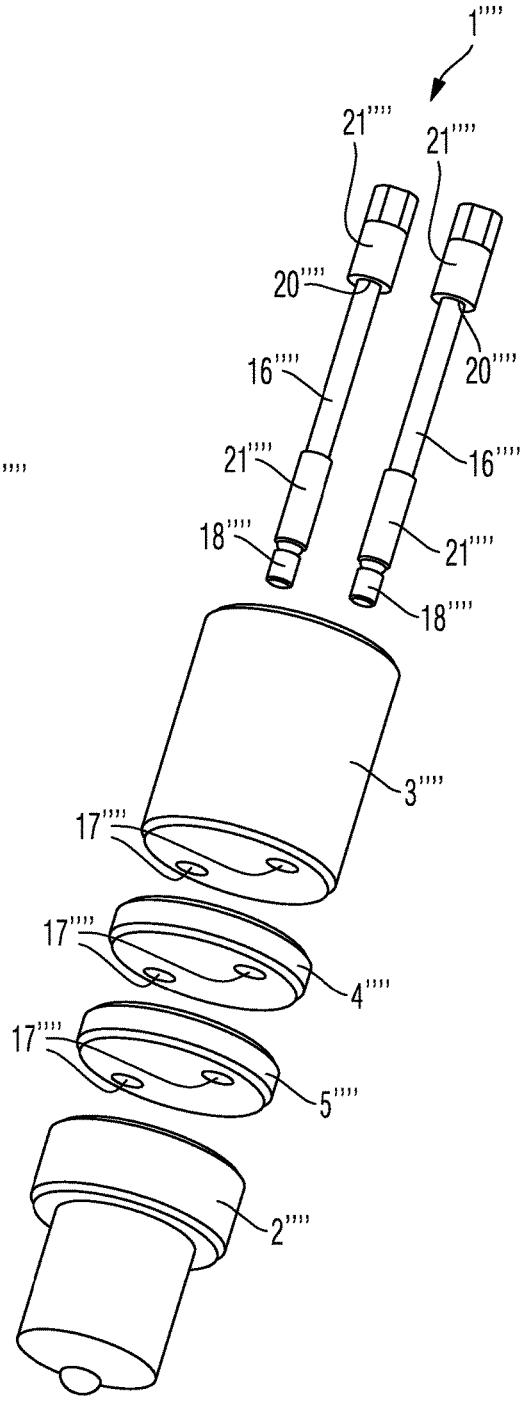
FIG. 8 is a highly schematic exploded view of the injector of FIG. 7.

A further embodiment of an injector 1"" according to the invention is shown in FIGS. 7 and 8. FIGS. 7 and 8 again show the injection nozzle 2"". the control valve 3"" and the intermediate plates 4"" and 5"" of the injector 1"" which are clamped according to the invention to form the composite 6"" which can then in turn be mounted on or disassembled from the retaining body, not shown, as a unit in a simple manner.

In the embodiment in FIGS. 7 and 8, clamping screws 16"" are used to clamp the composite 6"" comprising the elements or components mentioned above. The clamping screws 16"" extend into corresponding bore holes 17''',' which are incorporated in the above-mentioned components, i.e., in the injection nozzle 2"", the control valve 3"" and the intermediate plates 4"" and 5"".

The bore holes 17"" incorporated in the injection nozzle 2"" are threaded holes having an internal thread 22"", which cooperate with corresponding external threads 18"" of the clamping screws 16"".

The bore holes 17"" incorporated in the control valve 3"" and intermediate plates 4"" and 5"" are constructed as threadless through-holes. Shoulders 19"" are formed in the region of the through-holes 17"" of the control valve 3"", and a flange 20"" of the respective clamping screw 16"" contacts the shoulders 19"" so that when the clamping screws 16"" are tightened a corresponding clamping force is applied via the control valve 3"" to the composite 6"" comprising control valve 3"", injection nozzle 2"" and the existing intermediate plates 4"" and 5"".

Cylindrical pin-like cylindrical surfaces provide thickened portions 21' of the clamping screws 16"" in order to align and fix the clamping screws 16"" in position in the bore holes 17"" so as to ensure a defined clamping of the composite 16"".

In the illustrated embodiments of the injectors 1, 1', 1", 1''', 1"", two intermediate plates, namely the valve plate 4, 4', 4"" and the throttle plate 5, 5', 5"", are positioned between the respective injection nozzle 2, 2', 2"" and the respective control valve 3, 3', 3"". It is also possible to provide only one of these intermediate plates 4, 4', 4"" or 5, 5', 5"" or no intermediate plates.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. An injector for a fuel supply system of an internal combustion engine, comprising:

an injection nozzle having an external thread;

a control valve;

at least one radially extending intermediate plate configured as one of a valve plate and a throttle plate and axially positioned between the injection nozzle and the control valve, wherein the at least one intermediate plate is clamped between the injection nozzle and the control valve;

a clamping sleeve configured to seal and cover parting surfaces between one the control valve, the intermediate plate, and the injection nozzle, and having at least one radially inward directed projection; and wherein the clamping sleeve, the injection nozzle, the intermediate plate, and the control valve form a clamped assembly, and wherein the clamped assembly formed of the injection nozzle and the control valve is configured to be mounted and unmounted as a unit, wherein the control valve has at a radially outer lateral surface:

a radially inwardly directed recess configured as a circumferential groove, wherein the clamping sleeve has the at least one radially inwardly directed projection configured as a circumferential bead at a first portion that cooperates with the at least one of the radially inwardly directed recess of the control valve to fix the clamping sleeve in a position on the control valve, wherein the clamping sleeve has an internal thread at a second portion that mates with the external thread of the injection nozzle.

2. The injector according to claim 1, wherein the clamping sleeve is configured to cover the at least one intermediate plate.

3. The injector according to claim 2, wherein the radially inward directed projections of the clamping sleeve are spaced axially from one another, and wherein, after a deformation of the clamping sleeve that surrounds at least portions of the injection nozzle and the control valve during assembly of the injector, the radially inward directed projections engage by positive engagement in the radially inward directed projections while providing the clamped assembly.

4. The injector according to claim 1, wherein the clamped assembly is configured to be clamped when the injection nozzle and the clamping sleeve are screwed together, and wherein the clamping sleeve is configured to cover respective parting surfaces between one or more of the control valve, the injection nozzle, and the at least one intermediate plate.

5. The injector according to claim 1, further comprising:

bore holes that extend in longitudinal direction defined in each of the control valve and the injection nozzle; and clamping screws configured to extend into respective bore holes.

6. The injector according to claim 5, wherein the bore holes are threaded bore holes with internal thread at least in the injection nozzle that are configured to mate with external threads of the clamping screws, and wherein the bore holes have a shoulder configured to mate with a flange of the clamping screws so that the clamped assembly is clamped by tightening the clamping screws.

7. The injector according to claim 6, wherein the bore holes are incorporated in the at least one intermediate plate.

8. The injector of claim 1, wherein the fuel supply system is a common rail fuel supply system and the internal combustion engine is one of a large diesel internal combustion engine and a ship's diesel internal combustion engine.

9. The injector of claim 1, wherein the clamping sleeve has an internal thread at a second portion that only mates with the external thread of the injection nozzle.

10. The injector according to claim 1, wherein the at least one radially inward directed projection is arranged between axial ends of the clamping sleeve.

11. The injector according to claim 1, wherein at least one of the radially inwardly directed recess or the at least one shoulder of the control valve is arranged between axial ends of the control valve.

12. The injector according to claim 1, wherein the at least one radially extending intermediate plate, the injection nozzle, and the control valve have a substantially same radial dimension.

13. A fuel supply system, namely common rail fuel supply system of an internal combustion engine which is formed in particular as a large diesel internal combustion engine or ship's diesel internal combustion engine, comprising:

a low-pressure region;

a pump arrangement having at least one high-pressure pump to convey fuel from the low-pressure region of the fuel supply system into a high-pressure region;

a pressure accumulator system having at least one storage unit that is permanently under high pressure is arranged in the high-pressure region between the pump arrangement and injectors associated with cylinders;

at least one first high-pressure fuel line that is permanently under high pressure that couples the pressure accumulator system to the pump arrangement; at least one injector comprising:

an injection nozzle;

a control valve;

at least one radially extending intermediate plate axially positioned between the injection nozzle and the control valve, wherein the at least one intermediate plate is configured as one of a valve plate and a throttle plate and clamped between the injection nozzle and the control valve; and a clamping sleeve configured to seal and cover parting surfaces between the control valve, intermediate plate, and the injection nozzle, and having radially inward directed projections, wherein the clamping sleeve, the injection nozzle, injection nozzle, intermediate plate, and the control valve form a clamped assembly, and wherein the clamped assembly formed of the injection nozzle and the control valve is configured to be mounted and unmounted as a unit;

wherein the control valve has at a radially outer lateral surface:

a radially inwardly directed recess configured as a circumferential groove, wherein the clamping sleeve has the at least one radially inwardly directed projection configured as a circumferential bead at a first portion that cooperates with the at least one of the radially inwardly directed recess of the control valve to fix the clamping sleeve in a position on the control valve, wherein the clamping sleeve has an internal thread at a second portion that mates with the external thread of the injection nozzle.

* * * * *